US005494182A

United States Patent [19]

Clive-Smith

[11] Patent Number: 5,494,182

[45] Date of Patent: Feb. 27, 1996

[54] COUNTERBALANCING ON COLLAPSIBLE FLATRACKS

[76] Inventor: Martin Clive-Smith, 66 Leam Terrace, Leamington Spa, Warwickshire CV31 1BQ, United Kingdom

[21] Appl. No.: 391,785

[22] Filed: Feb. 21, 1995

[30] Foreign Application Priority Data

Feb. 24, 1994 [GB] United Kingdom ..... 9403569

[51] Int. Cl.[6] ..... B65D 6/18

[52] U.S. Cl. ..... 220/6; 220/7

[58] Field of Search ..... 220/6, 7, 1.5; 206/504, 206/509, 512

[56] References Cited

U.S. PATENT DOCUMENTS 3,480,174 11/1969 Sherwood ..... 220/1.5

4,099,640 7/1978 Nessfield et al. ..... 220/6

4,735,330 4/1988 Hoss ..... 220/6

5,275,301 1/1994 Clive-Smith ..... 220/6

*Primary Examiner*—Joseph M. Moy

*Attorney, Agent, or Firm*—Poms, Smith, Lande & Rose

[57] ABSTRACT

A collapsible flatrack assembly has a counterbalancing system whereby a normally upright post, pivotable relative to a horizontal base, is movable relative to the base under the action of a biasing force towards the upright position. The counterbalance includes a bar spring and a coacting follower which engages with the spring during movement of the post to deflect the spring.

24 Claims, 2 Drawing Sheets

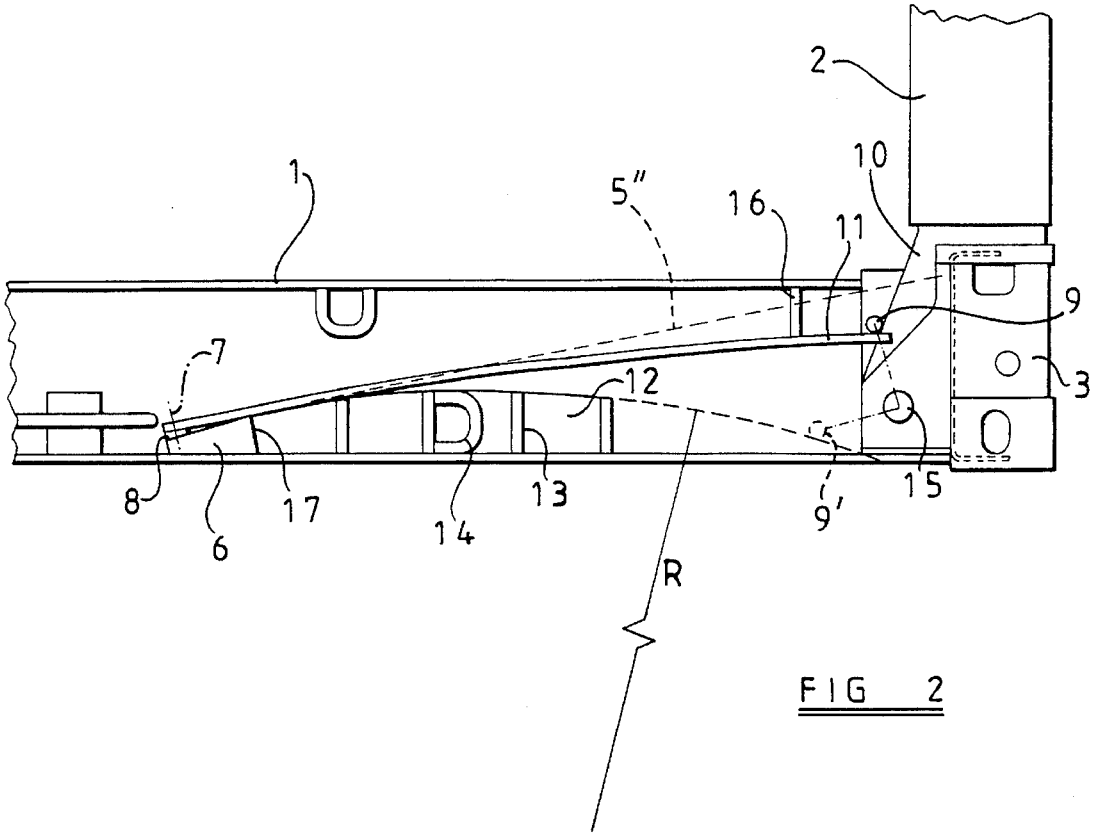
FIG 2
FIG 3
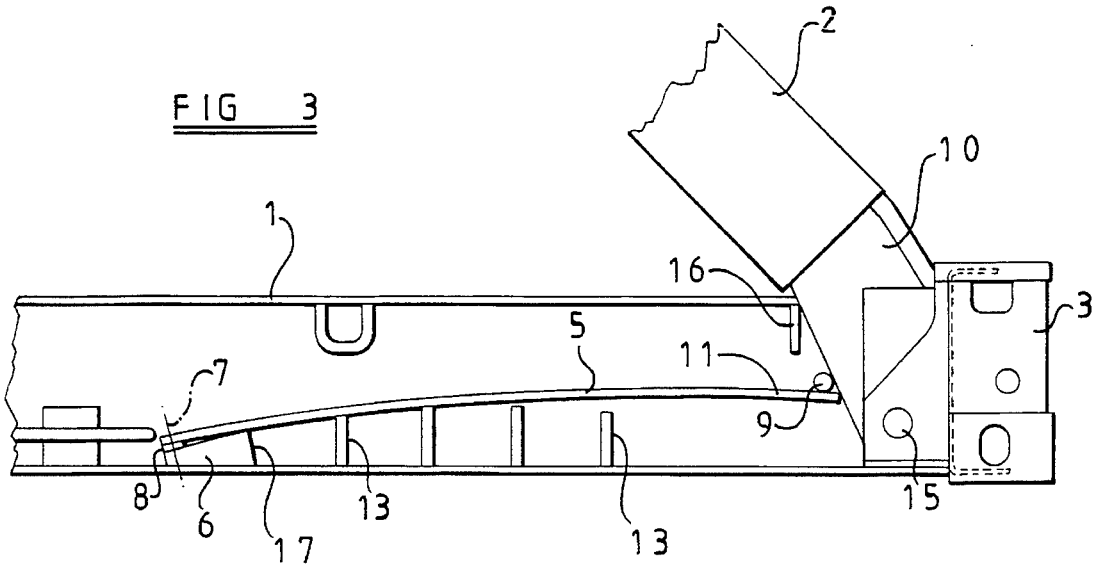

COUNTERBALANCING ON COLLAPSIBLE FLATRACKS

The present invention has application in the field of shipping containers. Within this field there is a particular type of container known as a collapsible flatrack which comprises a rectangular platform base with posts usually fixed at each corner. The posts are attached by hinges to the base so that they can be folded down onto the base. The hinges have locking devices to enable the posts to be fixed in the erect position. The posts are normally connected together at each end and a wall structure fixed between them. Collapsible flatracks are well known from earlier patents.

It is typical for flatracks to have their heavy posts which weigh as much as 300 kg each, fitted with counterbalance springs to enable them to be folded and raised manually. Counterbalancing saves the need for a crane or other lifting machine to prepare the flatracks for use, and also acts as a safety device in preventing the posts from falling down freely under their own weight and doing possible harm.

There are many different known types of collapsible flatrack and each type has its own post or end structure often having differing weights and height. Because the centre of gravity and weight vary, so too must the spring or other resilient biasing means needed to counterbalance the weight of the posts. It has long been sought to find a low cost spring which would suit many if not all the different types and thus offer the benefits of standardisation namely lower cost of production due to larger numbers made, and much simplified spare parts inventory.

For any given spring, there is typically a set of deflection load characteristics. Most commonly, a helical coil spring or a torsion bar spring are used having substantially linear load/deflection characteristics or rate. Once in its mounting the spring load at a given deflection is fixed and the spring cannot be easily adjusted or modified to increase or decrease the load at that deflection. In particular, if a pre-load is desired before commencement of folding of the posts, this is not easily nor reliably achieved with the common helical coil spring. Such pre-tension either increases the length of the spring unacceptably, or pre-tension manufactured within the spring this being more of an art than the science which is needed. Unfortunately, the demands made of the spring are not linear and thus the ideal counterbalance effect has to be compromised.

The present invention provides a counterbalancing system for a collapsible flatrack assembly comprising relatively pivoted first and second parts, one of said first and second parts comprising a normally upright post and the other of said parts comprising a normally horizontal base part of the flatrack assembly, the counterbalancing system comprising at least one bar spring mounted on said first part and a follower mounted on said second part, the follower being engageable with said bar spring on relative pivotal movement of said first and second parts, the bar spring having a fixed mounting portion and a free end, and the follower being arranged to make contact, on said relative pivotal movement of the first and second parts, with the bar spring adjacent said free end to deflect the spring in a direction tending to resist movement of the post from an upright towards a horizontal position, a former being provided on said first part between said fixed portion and said free end of the spring such that as said spring deflects, portions of the spring progressively come to rest on the former.

An embodiment of the invention is now described, by way of example only, and with reference to the drawings, in which:

FIG. 2 shows an enlarged view of the right hand flatrack corner with the embodiment of the invention in more detail;

FIG. 3 shows the same view as FIG. 2 but with the post partly folded.

Figure 1:
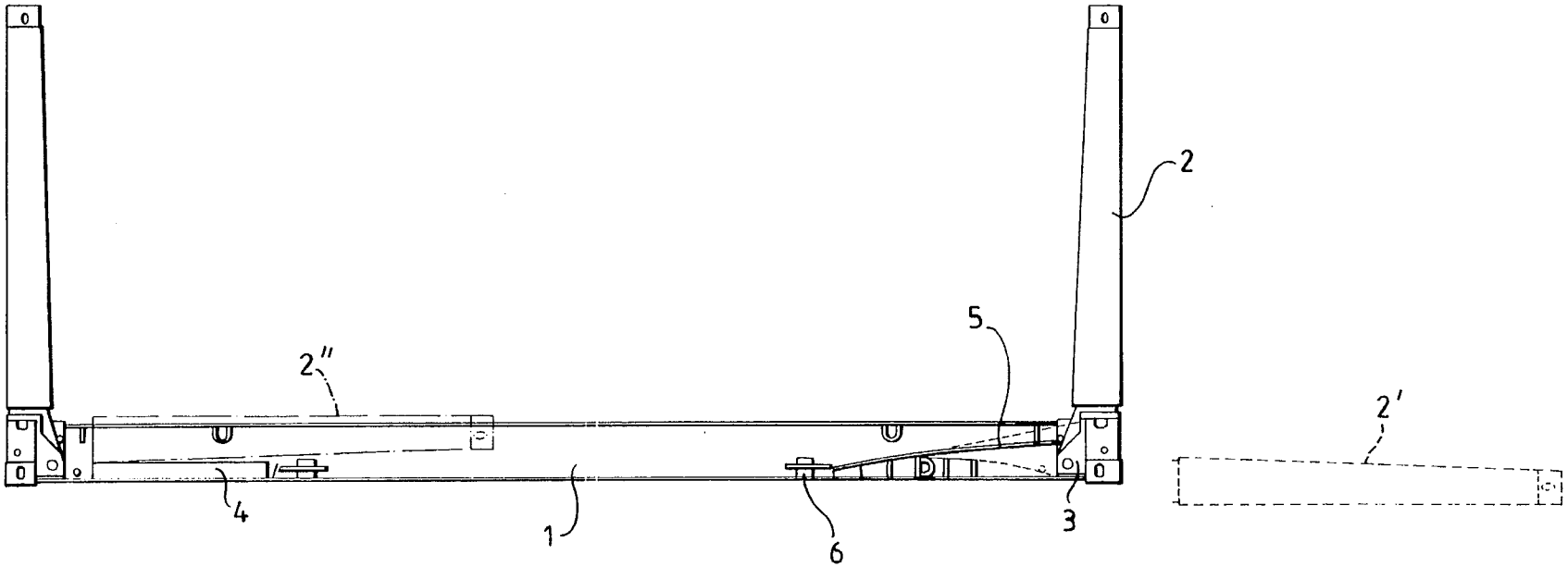
FIG. 1 shows the side élevation of a typical collapsible flatrack, showing prior art counterbalancing at the left hand side and an embodiment of the invention at the right hand side.

In FIG. 1 there is seen a typical collapsible flatrack comprising base 1, posts 2 attached by hinges 3 to base 1. The posts 2 are normally located at the extreme corners of the base 1, and the hinges 3 have some form of known looking device (not illustrated) to lock the posts 2 in the erect position. When the locks are released the posts 2 can fold down onto the base 1 and in some configurations fold outwards as post 2' to form a loading ramp for cargo to be driven up onto the base 1.

A known typical counterbalance spring 4 is at one end of the base 1, near the hinge 3, and described in detail in earlier published patents. At the other end is a preferred embodiment of the present invention comprising a bar spring 5 mounted to the base 1 at block 6. A bar spring 5 in this example is formed from high tensile spring steel from a rectangular bar.

FIG. 2 shows the spring 5 in more detail. The block 6 is fixed to base 1 and through block 6 is threaded a screw 7. Screw 7 passes through a hole formed in the fixed end of spring 5 and between spring 5 and block 6 is a spacer 8. The spring 5 cantilevers from the block 6 being supported by the edge 17 of the block 8 and the spacer 8. Spring 5 is seen to be inclined to the substantially horizontal base 1 and this inclination can be adjusted by releasing the screw 7 and/or changing the size of the spacer 8.

At the opposite free end 11 of spring 5, there is seen part of a post 2 comprising a hinge inner 10 onto which is fixed a follower 9. As hinge inner 10 rotates as the post 2 is folded down towards base 1, the follower 9 also moves until it contacts spring 5. Once in contact with spring 5, the follower 9 deflects spring 5 downwards building up a reacting force in spring 5 which tends to urge the post 2 back toward its erect position.

Under such a mounting, the spring 5 has maximum stress at the point of maximum bending moment in this example at the edge 17 of block 6. The bending stress at any location decreases along the spring 5 the further away from the edge 17 is the location. This might be acceptable but is an inefficient storage of energy within the spring 5. Such energy is needed to be stored to be able to raise the post 2 when required. If the post of one flatrack is of a different construction to another and perhaps heavier, then a different stronger spring would be needed. Significantly more energy can be stored if the spring 5 can be formed into a constant radius wherein the stress generated in the spring 5 is constant along its length. Thus spring 5 is supported by a former 12, then as the spring 5 is deflected downwards at free end 11 then it takes up the optimum radial chaps of former 12. Furthermore as post 2 reaches a horizontal position, the maximum counterbalancing effect is needed and thus the maximum force applied at the free end 11 of spring 5.

Another benefit of supporting the spring 5 by former 12 is that the angular deflection of free end 11 is potentially greater than had the spring 5 only been cantilevered from the block 6 for a given stress limit of the material from which the spring 5 might be made. The effective length of the spring 5 is reduced as the post 2 is lowered, and its effective angular deflection increases. By suitable choice of spring and former the spring force can be "tailored" to requirements.

Suppose in FIG. 3 at the deflection of the free end 11 shown, a spring 5 without former 12 has just reached its maximum allowable bending stress at edge 17 for the material of manufacture of the spring 5, then any further deflection of the free edge 11 will cause permanent bending of the spring 5 adjacent to edge 17. However in the present invention, the introduction of former 12 limits the bending which can take place at edge 17 thus enabling the spring 5 to deflect still further at free edge 11. Furthermore this increases the safety of the spring 5 since it cannot be over stressed by mistake. Spring 5 is also protected from impact damage by resting on former 12.

If the weight of posts are increased and more counterbalancing effect is needed, then the radius of curvature of the former can simply be decreased to develop greater energy in the spring 5.

Thus it can be appreciated that by providing supports such as former 12, more deflection can be developed and more energy stored in the spring 5.

A simplification of the former 12 can be made by the provision of a number of supports comprising plates welded to base 1. Any number of plates 13 can be positioned according to counterbalancing needs and their positions raised or lowered to suit counterbalancing needs and stress limitations of the steel used in spring 5. The plates 13 might be devised such as to allow for position adjustment either to a new position along the spring 5 or to a higher or lower contact point with the spring 5. Plates 13 might be placed above or below the spring 5 as required. A plate 13 nearer to the free end 11 and higher than the curve of radius R would tend to increase the load on follower 9 when in folded position 9'. Part of the support might comprise the structure of the flatrack itself such as plate 14 which has a dual function for example as a cargo lashing point.

The biasing force at the edge 17 of block 6 is determined by the moment at the point of contact of spring 5 with former 12 and the length of the projection from contact point and the follower 9. If at any position in the travel of the post 2 a smaller force is needed to act on the follower 9 to reduce the counterbalance effect, then the distance between the point of contact between spring 5 and former 12, and the follower 9 can be reduced, This comprises optimum energy store in spring 5 but allows tuning of the counterbalancing effect as required.

Before the post 2 starts to fold, the follower 9 can be out of contact with the spring 5. It is found in practice that the counterbalancing of the post 2 is not needed when the post 2 is near to its erect position since its centre of gravity acts close to the pivot pin 15. However it might be desirable to provide a pro-load in the spring 5 such that as soon as the follower 9 contacts spring 5, there is a strong biasing force to counter the weight of posts 2. To provide such a pro-load, the spring 5 is mounted by block 6 such that in an unloaded state, it would take up the position of dotted line 5". During setting up of spring 5, the spring 5 is forced downwards to position 5 and held there by pro-load plate 16. If the post 2 is to fold outwards as post 2' then the mounting of plate 16 would be reversed to force the spring 5 upward.

It is an advantage of plate 16 that it supports the spring 5 independently of post 2 or follower 9. Thus should it be desired to remove post 2 from the base 1, the pivot pin 15 can be removed and the post 2 lifted off base 1 without the need to disconnect spring 5 from its mounting.

In FIG. 3 the post 2 is seen at some intermediate folded position wherein the spring 5 has been deflected by follower 9 but has not yet made contact with the last plate 13. The counterbalancing needs of the posts 2 increases as the centre of gravity of the posts 2 moves further horizontally from the pivot pin 15. Thus the force at the free end 11 of spring 5 is required to increase and this it does by virtue of the decreasing moment arm being the distance between contact point of follower 9 on spring 5 and the point of contact of spring 5 on former 12 and/or plates 13.

In the present embodiment, the spring 5 is simply supported at block 6. However it is envisaged that other forms of mounting of spring 5 might be arranged either fully encased to increase rigidity or allowing a degree of flexibility as required.

The posts 2 might be mounted at the corners of the flatrack or intermediate positions along or across the base 1. The posts 2 might be joined together by structural members so that these posts fold together.

The spring 5 might be mounted above a follower such as 9 so as to counterbalance a post 2' which folds outward. Where the post 2' folds both outwardly and inwardly as post 2, one spring 5 might be provided to balance the weight of the posts 2 in both directions through the provision of an additional follower suitably positioned below the free end 11 of spring 5.

Spring 5 is envisaged in other arrangements to comprise a plurality of springs working substantially in parallel with one another though not necessarily of the same section, length or shape as spring 5.

A simple rectangular section is envisaged for spring 5 with constant section along its length. However tapered sections or other variations might be used to advantage.

Spring 5 in the preferred example is shown as a straight bar. However spring 5 might be formed as a curve, ellipse or other shape to suit geometric and rate requirements. For example if made as a curve of constant radius, then when such a curved spring deflected onto a former comprising a straight section, the curved spring of constant section would develop close to its optimum stress along its length.

It is possible for the mounting block 6 and spring 5 to be on the post 2 or on structure attached to the post 2 and the follower be mounted on the base 1. In this case, rotation of the post 2 rotates spring 5, the spring 5 now making contact with follower 9 mounted on base 1 and thus providing counterbalancing forces for post 2.

The follower may be shaped to engage the spring at differing points along its length as the follower rotates during folding of the post.

Where the spring is provided on the base, it may be recessed within the base for damage protection.

It is envisaged that the follower 9 be mounted on a mechanism such as a pin jointed linkage such that as the post folds the follower position along the spring 5 varies advantageously.

I claim:

1. A counterbalancing system for a collapsible flatrack assembly comprising relatively pivoted first and second parts, one of said first and second parts comprising a normally upright post and the other of said parts comprising a normally horizontal base part of the flatrack assembly, the counterbalancing system comprising at least one bar spring mounted on said first part and a follower mounted on said second part, the follower being engageable with said bar spring on relative pivotal movement of said first and second parts, the bar spring having a fixed mounting portion and a free end, and the follower being arranged to make contact, on said relative pivotal movement of the first and second parts, with the bar spring adjacent said free end to deflect the spring in a direction tending to resist movement of the post from an upright towards a horizontal position, a former being provided on said first part between said fixed portion and said free end of the spring such that as said spring deflects, portions of the spring progressively come to rest on the former.

2. A counterbalancing system according to claim 1 in which the position of the former is adjustable.

3. A counterbalancing system according to claim 1 in which the former comprises a plurality of individual supports.

4. A counterbalancing system according to claim 1 in which the mounting comprises one or more screws passing through apertures in the bar spring.

5. A counterbalancing system according to claim 1 in which the spring is pro-loaded by means of a plate mounted to urge the spring in the direction of its working deflection.

6. A counterbalancing system according to claim 1 in which the post movement can be inward and/or outward from the base.

7. A counterbalancing system according to claim 6 in which the characteristics of the spring differ outward to inward.

8. A counterbalancing system according to claim 1 in which the spring is mounted so as to have only sliding contact with the follower.

9. A counterbalancing system according to claim 3 in which the supports are adjustable to vary the characteristics of the spring force/deflection characteristic.

10. A counterbalancing system according to claim 1 in which the spring is mounted on the base of the flatrack.

11. A counterbalancing system according to claim 1 in which the spring comprises a plurality of spring means.

12. A counterbalancing system according to claim 11 in which the shape, section or size of all or any of the spring means can vary.

13. A counterbalancing system according to claim 1 in which the follower comprises a simple bar.

14. A counterbalancing system according to claim 1 in which the follower is shaped to engage the spring at differing points along its length as the follower rotates during folding of the post.

15. A counterbalancing system according to claim 1 in which there is more than one follower acting on the spring.

16. A counterbalancing system according to claim 1 in which there is free movement of the post before the follower makes contact with the spring.

17. A counterbalancing system according to claim 1 in which the spring is substantially curved.

18. A counterbalancing system according to claim 1 in which the former is substantially curved.

19. A counterbalancing system according to claim 1 in which the former comprises part of the base.

20. A counterbalancing system according to claim 1 in which the former comprises part of the post structure,

21. A counterbalancing system according to claim 1 in which the spring is recessed within the base for damage protection.

22. A counterbalancing system according to claim 1 in which the angle of the spring mounting is adjustable.

23. A collapsible flatrack comprising first and second parts comprising a normally horizontal base part and at least one normally upright post, and including a counterbalancing system comprising at least one bar spring mounted on said first part and a follower mounted on said second part, the follower being engageable with said bar spring on relative pivotal movement of said first and second parts, the bar spring having a fixed mounting portion and a free end, and the follower being arranged to make contact, on said relative pivotal movement of the first and second parts, with the bar spring adjacent said free end to deflect the spring in a direction tending to resist movement of the post from an upright towards a horizontal position, a former being provided on said first part between said fixed portion and said free end of the spring such that as said spring deflects, portions of the spring progressively come to rest on the former.

24. A collapsible flatrack comprising a normally horizontal base part and at least one normally upright post, and having a counterbalancing system according to claim 1.

* * * * *